US012305856B2

(12) United States Patent
Folkers et al.

(10) Patent No.: US 12,305,856 B2
(45) Date of Patent: May 20, 2025

(54) SURFACE STABILIZED FULLY PREMIXED GAS PREMIX BURNER FOR BURNING HYDROGEN GAS, AND METHOD FOR STARTING SUCH BURNER

(71) Applicant: BEKAERT COMBUSTION TECHNOLOGY B.V., Assen (NL)

(72) Inventors: Geert Folkers, Assen (NL); Gerben Van Vliet, Assen (NL); Camillo Hogenbirk, Assen (NL)

(73) Assignee: BEKAERT COMBUSTION TECHNOLOGY B.V., Assen (NL)

( * ) Notice: Subject to any disclaimer, the term of this patent is extended or adjusted under 35 U.S.C. 154(b) by 409 days.

(21) Appl. No.: 17/771,318

(22) PCT Filed: Oct. 23, 2020

(86) PCT No.: PCT/EP2020/079904
§ 371 (c)(1),
(2) Date: Apr. 22, 2022

(87) PCT Pub. No.: WO2021/078949
PCT Pub. Date: Apr. 29, 2021

(65) Prior Publication Data

US 2022/0390104 A1 Dec. 8, 2022

(30) Foreign Application Priority Data

Oct. 25, 2019 (NL) ..... 2024101

(51) Int. Cl.
*F23N 1/02* (2006.01)
*F23D 14/02* (2006.01)

(52) U.S. Cl.
CPC ..... *F23N 1/027* (2013.01); *F23D 14/02* (2013.01); *F23C 2900/9901* (2013.01); *F23N 2227/02* (2020.01)

(58) Field of Classification Search
CPC ..... F23N 2227/02; F23N 1/027; F23C 2900/9901; F23D 14/02
(Continued)

(56) References Cited

U.S. PATENT DOCUMENTS 6,270,336 B1 * 8/2001 Terashima ..... F23C 6/04 431/11
2005/0130085 A1 * 6/2005 Kamijo ..... F23N 5/20 431/6

(Continued)

FOREIGN PATENT DOCUMENTS

DE 197 44 008 4/1998
EP 3 043 115 7/2016

(Continued)

OTHER PUBLICATIONS

Slim, B.K. Darmeveil, H. van Dijk, G.H.J. Last, D. Pieters, G.T. Rotink, M. H. Overdiep, J.J. and Levinsky, H.B. Should We Add Hydrogen to the Natural Gas Grid to Reduce CO2-Emissions? 23rd World Gas Conference, Amsterdam 2006.*

(Continued)

*Primary Examiner* — Vivek K Shirsat
(74) *Attorney, Agent, or Firm* — Wenderoth, Lind & Ponack, L.L.P.

(57) ABSTRACT

Method for starting a burner wherein a premixed gas comprising a combustible gas and air is supplied, wherein the combustible gas comprises at least 50% by volume of hydrogen. The method comprises the following steps: during a start-up phase: supplying premixed gas having a first lambda-value to the burner surface, wherein the first lambda-value is at least 1.85, and igniting the supplied premixed gas having the first lambda-value using an ignition source. During an operation phase after the premixed gas has been ignited: supplying premixed gas having a second lambda-value to the burner surface, wherein the first (Continued)

lambda-value is larger than the second lambda-value. Independent claims for a burner and a heating appliance are included.

21 Claims, 5 Drawing Sheets

(58) Field of Classification Search
USPC ..... 431/6
See application file for complete search history.

(56) References Cited

U.S. PATENT DOCUMENTS

| | | | |
|---|---|---|---|
| 2006/0286498 | A1 | 12/2006 | Trimis et al. |
| 2008/0318172 | A1 | 12/2008 | Geiger et al. |
| 2012/0227411 | A1 | 9/2012 | Carroni et al. |

FOREIGN PATENT DOCUMENTS

| | | |
|---|---|---|
| EP | 3 336 427 | 6/2018 |
| JP | 61-13151 | 1/1986 |
| JP | 62-69018 | 3/1987 |
| JP | 6-109235 | 4/1994 |
| JP | 8-61670 | 3/1996 |
| JP | 10-103660 | 4/1998 |
| JP | 11-132420 | 5/1999 |
| JP | 11-201454 | 7/1999 |
| JP | 2002-188731 | 7/2002 |
| JP | 2006-349337 | 12/2006 |
| JP | 2008-279480 | 11/2008 |
| JP | 2011-106802 | 6/2011 |
| JP | 2013-519855 | 5/2013 |
| JP | 2017-530322 | 10/2017 |
| KR | 10-2007-0097930 | 10/2007 |
| WO | 02/44618 | 6/2002 |
| WO | 2009/077505 | 6/2009 |
| WO | 2011/069839 | 6/2011 |
| WO | 2020/182902 | 9/2020 |

OTHER PUBLICATIONS

International Search Report and Written Opinion of the International Searching Authority issued Feb. 3, 2021, in International (PCT) Application No. PCT/EP2020/079904.

A. Van Der Drift et al., "Low-$NO_X$ Hydrogen Burner", International Journal of Hydrogen Energy, vol. 21, No. 6, 1996, pp. 445-449.

C. M. Guirao et al., "Hydrogen-Air Detonations", Nineteenth Symposium (International) on Combustion/The Combustion Institute, 1982, pp. 583-590.

* cited by examiner

SURFACE STABILIZED FULLY PREMIXED GAS PREMIX BURNER FOR BURNING HYDROGEN GAS, AND METHOD FOR STARTING SUCH BURNER

The present invention relates to the field of surface stabilized fully premixed gas premix burners for burning a combustible gas comprising hydrogen gas, and method for starting such burner, as well as appliances comprising such burner.

Surface stabilized premix burners are well known for the combustion of hydrocarbon gases, such as natural, methane, and propane gas, in heating appliances, in particular in gas fired heating appliances. They offer benefits in size, emissions and the ability to adjust to different loads, also referred to as modulation.

The most common way of controlling the mixture of combustible gas and air in a gas fired heating appliance with surface stabilized premix burner is the use of a pneumatic gas valve. In this system ratio of the combustible gas and the air is determined by the gas valve. For example, the gas valve can be biased to a closed position and can be opened due to a pneumatic force. Said force is dependent on the flow of air, and the opening of the gas valve at a certain air flow is determined by the design of the gas valve. This is a master (air) slave (combustible gas) solution. There are other systems available, such as control valves. Some systems use a feedback loop to control the gas-air ratio.

Most systems apply the following sequence for igniting the combustible gas. A fan is started and in most cases it is established that it air is flowing. Then the ignition sequence is started by creating a spark or other ignition source on a burner surface of the burner. Next step is the opening of the gas valve. Provided the ratio of combustible gas to air is within a certain range, the ignition will take place.

In recent years the use of natural and propane gas has been criticized because of the carbon dioxide emissions. Hydrogen has been proposed as an alternative fuel, in particular for household and industrial heating appliances. However, hydrogen—or gaseous fuels having a significant content of hydrogen—have a different combustion behaviour than the traditional hydrocarbon gases, e.g. a higher flame speed. The different combustion behaviour may lead to a number of problems, e.g. flame flashback. Flame flashback is the occurrence that happens when an upstream propagation of flame propagates back into the burner, which can be caused by a high flame speed.

International patent application WO 2020/182902, which claims priority from European patent application with application number EP19162278 of the present applicant discloses a method for adapting the ratio of air to combustible gas based on the load of the burner, to mitigate risks such as flashback. EP19162278 and WO 2020/182902 are incorporated herein by reference.

If a system using hydrogen as fuel is started in accordance with the sequence as described above, and the ignition is delayed for whatever reason, a mixture comprising hydrogen will be fill up the combustion chamber. Test have shown that if the ignition does take place with the combustion chamber at least partly filled with hydrogen gas-air mixture there could be an explosion-like combustion that could damage components of the heating system.

In addition, standards have been created to ensure safe operation of burners. In the standards several tests are described as criteria for acceptance. For example, European standard EN15502-1 gas fired heating boilers part 1 General requirements and tests, for natural gas and LPG, described several tests. Although at this moment there are no standards for hydrogen as fuel, it is expected that similar safety test as described in EN15502-1, will be applicable for future gas fired heating boilers using other gases than e.g. mentioned in EN437. Also outside of Europe, similar standards exist and/or are expected to be developed for hydrogen as fuel.

One of the tests in the current standards is the "delayed ignition test". During the delayed ignition test, combustible gas and air are first being introduced into the combustion chamber for a short period of time before being ignited with the ignition source. This should not lead to damage or other unwanted side effects. However, tests have found that when traditional burners are used with hydrogen as fuel, flame flashback may occur during this test.

It is an object of the invention to mitigate one or more of the disadvantages explained above, or at least provide an alternative to the existing methods and burners.

This object is achieved with each of the methods, burners and hydrogen gas fired heating appliances according to the invention as described herein.

The invention relates to a method for starting a burner wherein a premixed gas comprising a combustible gas and air is supplied to a burner surface of the burner, wherein

- the combustible gas comprises at least 50% by volume of hydrogen,
- a lambda-value is defined as a ratio between an actually supplied quantity of air and the quantity of air required for stoichiometric combustion of the premixed gas,
- the burner preferably is a surface stabilized fully premixed gas premix burner,
- the burner preferably is configured to be modulated between a minimum load and a full load, wherein the method comprises the following steps

- during a start-up phase: supplying premixed gas having a first lambda-value to the burner surface, wherein preferably the first lambda-value is at least 1.85, and igniting the supplied premixed gas having the first lambda-value using an ignition source,
- preferably during an operation phase after the premixed gas has been ignited: supplying premixed gas having a second lambda-value to the burner surface, wherein the first lambda-value is larger than the second lambda-value.

The present invention relates to a method for starting a burner. The burner is preferably a surface stabilized fully premixed gas premix burner, which may e.g. be used for heating appliances in household and/or industrial applications. In such applications, it may be desired that the burner is able to be functional at a range of loads. For example, in a household application the required load when a resident is having a shower with hot water may be much larger than the required load for maintaining the temperature of the residence. Therefore, the burner is preferably configured to be modulated between a minimum load and a full load. The modulation ratio, defined as the ratio of the full load over the minimum load, may e.g. be at least 3, preferably more than 4, more preferably more than 5, more preferably more than 7, more preferably more than 10. For example, the full load of the burner may be 24 kW, e.g. when the burner is used for a household heating appliance such as a boiler.

In accordance with the invention, a premixed gas comprising a combustible gas is supplied to a burner surface of the burner. The combustible gas comprises at least one gaseous fuel which can be burned to provide heating energy, which in the present invention is hydrogen. It is noted that some gases used in traditional heating appliances may comprise small amounts of hydrogen; however, in these mixtures the combustion behaviour is still practically completely determined by the hydrocarbons which are dominantly present. It has been found that the combustion behaviour changes significantly in comparison to traditional hydrocarbon gases when the combustible gas comprises a significant amount of hydrogen. In particular, in the context of the present invention, the combustible gas comprises at least 50% by volume of hydrogen. In addition to the hydrogen, the combustible gas may e.g. comprise additives, such as colorants and odorants, or nitrogen. It is also possible that carbon monoxide or carbon dioxide, formed during the production process of the hydrogen, is present. The combustible gas may also comprise small amounts of hydrocarbons such as methane or propane. These hydrocarbons may be added intentionally to lower the price of the combustible gas, or they may be residual gases present in pipes used for the distribution of hydrogen, said pipes previously being used for the distribution of said hydrocarbons. The combustible gas may also comprise small amounts of oxygen, which consequently may affect the amount of oxygen or air that needs to be added for combustion. It may depend on the required purity of hydrogen which additional chemicals are present in what concentration.

The premixed gas also comprises air. The air comprises oxygen, which is required such that the combustible gas can be ignited. Usually, the air is taken from the environment, e.g. outside, of where the burner is located. Dependent on the composition of the combustible gas on the one hand, and the composition of the air on the other hand, a certain quantity of air is required for stoichiometric combustion of the premixed gas. In practice, however, the actual quantity of air that the premixed gas comprises will differ therefrom. Traditionally with hydrocarbon gases, a small excess of air is provided, to avoid incomplete combustion which could lead to carbon monoxides. A lambda-value is defined as a ratio between an actually supplied quantity of air and the quantity of air required for stoichiometric combustion of the premixed gas. The lambda-value thus represents the excess of air.

According to the invention, the method comprises a first step of, during a start-up phase, supplying premixed gas having a first lambda-value to the burner surface. During the start-up phase, the supplied premixed gas having the first lambda-value is ignited using an ignition source.

It is noted that in some embodiments, the ignition source may already be activated, e.g. sparking, before the premixed gas having the first lambda value is supplied. Furthermore, in some embodiments air may first be supplied to the burner surface, followed by the ignition source being activated, and then followed by combustible gas to be supplied to the premixed gas, and said premixed gas then having the first lambda value being supplied to the burner surface.

The method preferably further comprises a step of, during an operation phase after the premixed gas has been ignited, supplying premixed gas having a second lambda-value to the burner surface. According to the invention, the first lambda-value is larger than the second lambda-value.

A difference is made between a start-up phase and an operation phase. The start-up phase includes supplying premixed gas with a first lambda-value and igniting said supplied premixed gas. It should be noted that it is possible that the burner is modulated to a different load in the start-up phase relative to the operation phase. Even in the start-up phase and/or the operation phase itself, it is possible to modulate the burner to different loads. In such cases, it is possible that the first and/or second lambda-value is not constant.

The invention entails that initially, during the start-up phase, the premixed gas supplied to the burner surface comprises a relatively large excess of air. It has been found by the inventors, that the flame speed is reduced when the premixed gas comprises more air, and as such the risk of flame flashback is reduced as well. Furthermore, it has been found after the premixed gas with the first lambda-value that was present has been ignited, premixed gas with a lower lambda-value can be supplied during the operation phase. Since there is no or at least less accumulated premixed gas present anymore, the risk of flame flashback is reduced.

An additional advantage of the invention is that the chance of flashback due to recirculation is reduced. Recirculation occurs when the outlet gasses are sucked into the inlet of the burner, e.g. into the inlet of the fan. In practice recirculation may e.g. occur when the outlet and inlet of a boiler system are arranged close to each other, e.g. on the roof of a building. Certain weather conditions such as strong wind may increase recirculation. When recirculation occurs, the air provided by the fan comprises less oxygen. In addition, during the start-up phase before the combustible gas is ignited, also unburned combustible gas may be recirculated. As a result the ratio of oxygen to combustible gas is in the premixed gas supplied to the burner surface is reduced, i.e. the actual lambda-value is reduced. By controlling the lambda-value during the start-up phase to be higher, the chance of flashback is reduced.

Advantageously, the excess of air can optionally be reduced, such that the second lambda-value during the operation phase can be chosen such that other characteristics are improved, e.g. efficiency. The first lambda-value is preferably at least 1.85. It has been found that this is a practical lower limit with satisfying results. It should be noted that traditional hydrocarbons such as methane will not or very badly combust at a lambda-value of 1.85 or larger.

The lambda-value can be controlled during the start-up phase and optionally the operation phase. The lambda-value can e.g. be controlled by controlling the quantity of air supplied by an air channel and/or the quantity combustible gas supplied by a combustible gas channel, e.g. by using a controller. Several practical ways of controlling the lambda-value will be elaborated herein.

In an embodiment, the burner comprises a premixed gas supply circuit, comprising: an air channel for supplying air; a combustible gas channel for supplying combustible gas; a mixing channel for mixing air supplied by the air channel and combustible gas supplied by the combustible gas channel into the premixed gas to be supplied to the burner surface; and at least one channel obstruction element for partially obstructing the combustible gas channel and/or the air channel. In this embodiment, the method further comprises the following steps: during the start-up phase: partially obstructing the combustible gas channel with the at least one channel obstruction element, such that less combustible gas is provided to the mixing channel during the start-up phase relative to the operation phase; and/or during the operation phase: partially obstructing the air channel with the at least one channel obstruction element, such that more air is provided to the mixing channel during the start-up phase relative to the operation phase.

In this embodiment, the channel obstruction element is used to obstruct the combustible gas channel and/or the air channel, such that less combustible gas and/or air, respectively, is supplied to the premixed gas. As such the lambda-value can be adapted, e.g. from the first to the second lambda-value. The channel obstruction element can be embodied in numerous ways, several of which will be explained in more detail herein further below.

In an embodiment, the at least one channel obstruction element is arranged in a rest position in the start-up phase. In this embodiment, the method further comprises the step of actuating the channel obstruction element to arrange the channel obstruction element in an actuated position during the operation phase.

Thus, the rest position of the channel obstruction element corresponds with the start-up phase. A step of actively actuating the channel obstruction element is required to achieve to lower second lambda-value. In the event of a malfunction wherein said actuating step cannot be completed, the premixed gas during the operation phase will still have the first lambda-value, which may lead to an unsatisfactory efficiency. However, failure will not affect the first lambda-value during the start-up phase. The channel obstruction element is as such fail-safe.

In an embodiment, first lambda-value is larger than 1.9, preferably larger than 2, e.g. between 2-5, preferably larger than 3, e.g. between 3-5, more preferably larger than 4, e.g. between 4-5. The larger the first lambda-value, the smaller the chance of flame flashback when the premixed gas with the first lambda-value is ignited. However, if the first lambda-value is too large, it may happen that the premixed gas will not combust because there is too little combustible gas present. In addition, efficiency of the burner may decrease as the first lambda-value increases. Tests have shown that a suitable upper limit is 7, preferably 6, more preferably 5. For example, the first lambda-value may be between 2-7, 2-6, 3-7, 3-6, 4-7, or 4-6.

In an embodiment, the second lambda-value is between 1 and 2, preferably between 1.05 and 1.5, more preferably between 1.05 and 1.3. Optionally the second lambda-value is the lambda-value at full load. These have shown to be suitable lambda-values for a safe, efficient operation. Although the theoretically required quantity of air corresponds with a lambda-value of 1, it may be preferred to provide a small excess of air during the operation phase. This entails that the flame speed is a bit lower, and also provides a buffer to avoid incomplete combustion in situations where the air contains less oxygen than normal, e.g. due to weather conditions or the burner being on a location with idle air, or when the combustible gas comprises a composition that differs from an expected condition. Incomplete combustion results in lower efficiency since less of the energy in the combustible gas is used. Incomplete combustion may also cause safety issues if the concentration of the combustible gas in the exhaust gases is too high, since this may cause explosion or fire further downstream in undesired locations. Furthermore, decreasing lambda-value may also result in an increase of NOx in the exhaust gasses.

In an embodiment, the first lambda-value is at least 1.5 times as large as the second lambda-value, preferably at least 2 times as large, e.g. at least 3 times as large. It has been found that these are practical first lambda-values with which satisfying results can be achieved.

In an embodiment, the combustible gas comprises at least 75% by volume of hydrogen, preferably at least 80% by volume of hydrogen, more preferably at least 95% or at least 98% by volume of hydrogen. As the combustible gas comprises more hydrogen, the advantages associated with using hydrogen as fuel increase. At the same time, however, the flame speed and risk for flame flashback increase, making the invention even more advantageous.

In an embodiment, the start-up phase lasts at least 1 second, preferably at least 2 seconds, and even more preferably at least 3 seconds, e.g. between 3-6 seconds. Preferably, the start-up phase is long enough such that it is ensured that the supplied premixed gas is ignited. Therefore, the start-up phase may last at least a bit, e.g. 1-2 seconds, after the ignition source has been activated. The start-up phase may also last at least a bit, e.g. 1-2 seconds, after a flame is detected by a flame detector. This ensures that the premixed gas having the first lambda-value has been ignited before the operation phase starts. In case a flame detector is used, it may also take some time, e.g. 1-2 seconds, after the ignition source has been activated for the flame to be detected. In case the burner is started for a delayed ignition test, the standard EN15502-1 prescribes that the start-up phase can last as long as 10 seconds. In case the premixed gas having the first lambda-value has not been ignited, e.g. when no flame is detected, the starting of the burner may e.g. be aborted, e.g. after a predetermined time, e.g. corresponding with a safety time in accordance with EN15502. Optionally after said aborting, the method according to the invention may be restarted.

In an embodiment, the method comprises a step of setting the fan to a high load during start-up, e.g. more than 80% of the rotations per minute, RPM, of full load, e.g. more than 90% of the RPM of full load, e.g. more than 95% of the RPM of full load, e.g. at full load.

The advantage of this embodiment can be understood from an example where a resident wants to take a hot shower while his boiler comprising the burner is turned off. To heat the water for the shower enough, the burner is desired to be on full load. In traditional burners, however, the burner must be started on a lower load, e.g. 25-40% of the load. Only after the combustion has started, the burner can slowly be increased to full load by adapting the fan speed. However, this takes several seconds, e.g. because safety and a correct mixture of the premixed gas must be ensured while the flow of the fan is increased. With the present invention on the other hand, more air is provided during the start-up phase. Therefore, it is possible to set the fan at a high load before the combustible gas is added to the premixed gas, which can be done faster. Once the combustion has started, the quantity of combustible gas can be adapted in the operation phase and the burner is faster at the desired high or full load. Therefore, the resident has hot water in his shower faster when the method according to this embodiment is applied.

In an embodiment, the second lambda-value is adapted in function of the load. This is described in detail in International patent application WO 2020/182902, which claims priority from European patent application with application number EP19162278, both of the present applicant. EP19162278 and WO 2020/182902 are incorporated herein by reference. As explained in EP19162278 and WO 2020/182902, the lambda-value at the minimum load may be at least 20% higher than at full load, and optionally at average load the lambda-value may be less than 10% higher than at full load. In general, the burner will be started on a load within the modulation range. In accordance with the invention, the first lambda-value at any given load is higher than the second lambda-value at said load, when the burner is started at said load. In some embodiments, however, the burner may be started at a load that is below the minimum load, although this is limited by a reduced minimum load. Below said reduced minimum load it may not be possible to determine that ignition occurred, or it may not be possible to maintain a stable combustion. On the other hand, above the full load it may also not be possible to determine that ignition occurred, because the increased speed of the premixed gas coming through the burner surface may cause the flame to be further from the burner surface than the flame detection sensor.

In an embodiment, the second lambda-value is defined as the lambda-value during operation at the same load at which the burner is started.

In an embodiment, the second lambda-value is defined as the lambda-value during operation at the full load of the burner.

In an embodiment, the burner is started at a start-up load in the start-up phase which is different from a desired load in the operation phase, wherein the method further comprises a transition phase to transition from the start-up phase to the operation phase after the premixed gas has been ignited, wherein transition phase comprises a step of changing the load to the desired load.

For example, in practice a predetermined second lambda-value may be stored in a memory for each load during the operation phase. Said second lambda-value may be different in function of the load. If the burner is started at a start-up load, the first lambda-value will be larger than the second lambda-value corresponding with start-up load if the load in the operation phase would be equal to said start-up load, in accordance with the invention. It is possible, however, that the burner is usually started at the start-up load, which may e.g. be a relatively low load, irrespective of a desired load that is actually desired in the operation phase. In case the desired load in the operation phase differs from the start-up load at which the burner is started in the start-up phase, there may be a transition phase to transition from the start-up phase to the operation phase after the premixed gas has been ignited.

In a first embodiment the transition phase comprises a step changing the lambda-value of the premixed gas that is being supplied to the second-lambda value associated with the start-up load if the load in the operation phase would be equal to said start-up load, and then a step of changing the load to the desired load and changing the lambda-value to the second lambda-value associated with said desired load.

In a second embodiment the transition phase comprises a step of changing the load to the desired load while keeping the lambda-value of the supplied premixed gas at the first lambda-value, and then changing the lambda-value to second lambda-value associated with the desired load.

In a third embodiment the transition phase comprises a step of simultaneously changing the load to the desired load and changing the lambda-value of the supplied premixed gas to second lambda-value associated with the desired load.

In case the desired load is greater than the start-up load, the first and third embodiment of the transition phase may be preferred, because in the second embodiment the fan may not be able to supply the first-lambda value at the higher desired load.

It is noted that in case the desired load is smaller than the start-up load, the second lambda-value associated with the desired load may actually be larger than the first lambda-value at which the burner is started at the start-up load. However, in accordance with preferred embodiments of the invention, the first lambda-value at which the burner is started is larger than the second lambda-value associated with the start-up load if the load in the operation phase would be equal to said start-up load.

In an embodiment, the first lambda-value is below a blow-off value. The blow-off value is the lambda-value at which there is so little combustible gas relative to air in the premixed gas, that any flame at the burner surface is blown out by the premixed gas, because there is not sufficient combustible gas to keep the flame burning.

In an embodiment, the first lambda-value is such that the concentration of combustible gas in the premixed gas is below an upper flammability limit, also referred to as UFL, and/or above a lower flammability limit, also referred to as LFL. It should be noted that the lower and upper flammability limit are determined by the composition of the combustible gas, but also dependent on factors such as temperature and pressure. Above the UFL the premixed gas may be too rich to burn, below the LFL it may be to lean to burn.

In an embodiment, the first lambda-value corresponds with a quantity of air that is lower than a quantity of air provided by the fan, when said fan is on full load.

In an embodiment, the first lambda-value is such that the concentration of combustible gas in the premixed gas is below a lower explosion limit, also referred to as LEL, meaning that the first lambda-value should be above a lambda value corresponding with the LEL. It may be preferable to control the first lambda-value to differ more than a predetermined safety margin from the lower explosion limit, e.g. the safety margin being a factor 1.2 or 1.5. This ensures safe start-up, even when the actual composition of the air or combustible gas differs from expectation. It should be noted that for many gases, LEL and LFL correspond, but for hydrogen comprising gases this is different. For hydrogen comprising gases, there is a range of concentration at which the premixed gas is flammable but cannot explode, which is a preferred range for the start-up phase. Said range depends on temperature, pressure, possible other components in the combustible gas, and the mixing. For pure hydrogen, when the premixed gas comprises 4-17% by volume of hydrogen, the concentration is between LFL and LEL.

In an embodiment, the method further comprises a step of maintaining the ignition source in an ignition state for an ignition period after it has been detected that the supplied premixed gas having the first lambda-value has been ignited. The ignition state corresponds with the action that the ignition source performs for igniting the premixed gas. For example, the ignition source may keep sparking during the ignition state. For example, when the ignition source is a glowplug or hot surface igniter, the current provided to it may be maintained at a level that causes the ignition source to glow at a temperature that causes the premixed gas to ignite. The ignition period may e.g. be a predetermined period, e.g. 1 second, 2 seconds, or 5 seconds. The ignition period may e.g. overlap with an end period of the start-up phase, and/or a begin period of the operation phase, and/or a transition phase between the start-up phase and the operation phase wherein the lambda-value is adapted towards the second lambda-value and/or the load is adapted from a start-up load to a desired load. In embodiments, the burner is started a start-up load in the start-up phase which is different from a desired load in the operation phases, wherein the ignition source is maintained in the ignition state until the burner has been modulated to the desired load and/or the second lambda-value associated with the desired load.

This embodiment allows that in case there is accumulated premixed gas, e.g. inside of the burner or in a combustion chamber, said accumulated premixed gas is ignited by the ignition source. Accumulation of premixed gas may e.g. happen when the flame has quickly moved further away from e.g. the burner surface without burning all the gas present. The accumulated gas could cause unexpected and/or undesired behaviour of the flame, e.g. after the flame speed changes, which may e.g. happen when the burner is modulated to a different load. By igniting and burning the accumulated gas, this embodiment avoids said unexpected and/or undesired behaviour, and thus further reduces risks of e.g. flame flashback. It is noted that in this embodiment in may be advantageous if the ignition source is a glowplug or hot surface igniter, in particular when a flame detector is used for which a spark of a spark igniter adversely affects the flame detection. It is also possible to stop the ignition source, e.g. being a spark ignited, in order to detect the flame, and after detection of the flame start the ignition period.

The invention further relates to a burner configured to perform the method according to the invention. Preferably, said burner is a surface stabilized fully premixed gas premix burner. Optionally, said burner is also in accordance with the burner described below.

The invention further relates to a burner as described below. The method according to the invention may be performed with said burner; however, neither the method nor the burner are limited thereto. Nevertheless, features and definitions explained with reference to the method according to the invention may be interpreted similarly when mentioned in reference to the burner, and vice versa. Furthermore, features and/or embodiments explained with reference to the method according to the invention may be added to the burner according to the invention to achieve similar advantages, and vice versa.

The invention relates to a burner for burning a combustible gas comprising at least 50% by volume of hydrogen, wherein said burner preferably is a surface stabilized fully premixed gas premix burner, and wherein said burner preferably is configured to be modulated between a minimum load and a full load, said burner comprising

- a burner surface,
- a premixed gas supply circuit, comprising
  - i. an air channel for supplying air,
  - ii. a combustible gas channel for supplying combustible gas,
  - iii. a mixing channel for mixing air supplied by the air channel and combustible gas supplied by the combustible gas channel into a premixed gas to be supplied to the burner surface, wherein a lambda-value is defined as a ratio between an actually supplied quantity of air and the quantity of air required for stoichiometric combustion of the premixed gas,
- an ignition source for igniting the premixed gas supplied to the burner surface,
- a controller configured to control the lambda-value of the supplied premixed gas by controlling the quantity of air supplied by the air channel and/or the quantity combustible gas supplied by the combustible gas channel, wherein the controller is configured to
  - i. supply premixed gas having a first lambda-value during a start-up phase of the burner wherein the ignition source is configured to ignite the supplied premixed gas having the first lambda-value, wherein the first lambda-value is preferably at least 1.85, and
  - ii. preferably supply premixed gas having a second lambda-value during an operation phase of the burner after the ignition source is configured to ignite the supplied premixed gas having the first lambda-value, wherein the first lambda-value is larger than the second lambda-value.

The burner according to the invention preferably is a surface stabilized fully premixed gas premix burner. In this context, surface stabilized should be interpreted as that during normal operation, the flame is intended to be on or close to the burner surface. In this context, fully premixed gas should be interpreted as (substantially) all air being added before the premixed gas reaches the burner surface. This is different than e.g. nozzle mix systems, where the combustible gas and air meet at the burner surface, or partially premixed system, where part of the air is added before the gas reaches the burner surface and part of the air is supplied directly to the burner surface.

The burner is adapted for burning a combustible gas comprising at least 50% by volume of hydrogen, and can be modulated between a minimum load and a full load. The full load is dependent on the intended application, e.g. for a single household, multiple households such as an apartment building, or industrial. Examples of full load may e.g. be 20 kW, 24 kW, 30-40 kW, 90-150 kW, 200-300 kW, 2200-3000 kW.

The burner according to the invention comprises a premixed gas supply circuit, a burner surface and an ignition source. The premixed gas is supplied by the premixed gas supply circuit to the burner surface. The burner surface may e.g. comprise openings or perforations, e.g. round or elongated, though which the premixed gas can flow, e.g. into a combustion chamber. The ignition source is arranged in the vicinity of the burner, e.g. in the combustion chamber. The ignition source is configured to ignite the premixed gas such that the premixed gas combusts and/or starts burning. The ignition source may e.g. be a spark igniter, a glowplug or hot surface igniter. Once the premixed gas is ignited, a flame is present. As long as the flame is present, the premixed gas supplied to the burner surface will normally be ignited as soon as it reaches the flame. Ideally, during the operation phase, a flame is present on the burner surface. The burner surface can have any suitable shape, e.g. round, curved or flat.

The premixed gas supply circuit comprises an air channel, a combustible gas channel, and a mixing channel. In the mixing channel, air supplied by the air channel and combustible gas supplied by the combustible gas channel is mixed into the premixed gas. The mixing may be achieved naturally by the flow, or optionally with the aid of mixing elements such as a fan. The air channel may e.g. be connected to environmental air, e.g. by a suction inlet, for providing the air, which may e.g. be supplied into the mixing channel by means of a fan. Said fan can be arranged upstream or downstream of the mixing channel. Normally, the volume of air that is required is larger than the volume of combustible gas that is required. The air channel may therefore be larger than the combustible gas channel. Preferably the combustible gas is supplied to the mixing channel at least partially by the use of a Venturi effect. This can e.g. be achieved by providing the air channel with a narrowing or narrower portion at the location where the combustible gas channel is connected to the air channel. This narrowing or narrower portion will cause a local increase in flow speed of the air, thereby reducing the pressure and exerting a suction force on the combustible gas.

According to the invention, the burner further comprises a controller. The controller is configured to control the lambda-value of the supplied premixed gas. The controller can be configured to do this in numerous ways, several embodiments of which will be elaborated on further below. In general, the controller is configured to control the lambda-value by controlling the quantity of air supplied by the air channel and/or the quantity combustible gas supplied by the combustible gas channel.

According to the invention, the controller is configured such that during the start-up phase, premixed gas having a first lambda-value is supplied to the burner surface and the supplied premixed gas is ignited by the ignition source. Only after the supplied premixed gas having the first lambda-value is ignited, will the controller control the lambda-value such that during the operation phase premixed gas having a second lambda-value is supplied. According to the invention, the first lambda-value is larger than the second lambda-value, and preferably the first lambda value is at least 1.85. As such, the same advantages as associated with the method according to the invention are achieved.

In an embodiment, the burner further comprises at least one channel obstruction element for partially obstructing the combustible gas channel and/or the air channel. The controller further is configured to control the at least one channel obstruction element to partially obstruct the combustible gas channel during the start-up phase and/or partially obstruct the air channel during the operation phase.

The channel obstruction element can be embodied in various ways, several of which will be explained in more detail further below. By partially obstructing the combustible gas channel or air channel, less combustible gas or air, respectively, will enter the mixing channel. By obstructing the gas channel during the start-up phase and/or the air channel during the operation phase, it can be achieved that the first lambda-value is larger than the second lambda-value.

In general, the channel obstruction element preferably has at least a first position in which it partially obstructs the combustible gas channel or the air channel by being arranged in said respective channel. It further has a second position in which it either is not arranged in the respective channel, or at least obstructs the respective channel less. Optionally, in the second position or in an additional third position the channel obstruction element obstructs the respective other channel.

In an embodiment, the at least one channel obstruction element has an actuated position and a rest position, wherein the at least one channel obstruction element is configured to be in the actuated position during the operation phase and in the rest position during the start-up phase.

Thus, the rest position of the channel obstruction element corresponds with the start-up phase. A step of actively actuating the channel obstruction element is required to achieve to lower second lambda-value. In the event of a malfunction wherein this actuating step cannot be completed, the premixed gas during the operation phase will still have the first lambda-value, which may lead to an unsatisfactory efficiency. However, failure will not affect the first lambda-value during the start-up phase. The channel obstruction element is as such fail-safe.

Whether the rest position corresponds with the first or second position, depends on whether the channel obstruction element is arranged in the combustible gas channel or in the air channel.

In an embodiment the at least one channel obstruction element is configured to be actuated by a pneumatic, hydraulic, magnetic or mechanical force to obstruct the combustible gas channel and/or the air channel.

In an embodiment, the burner comprises a gas valve in addition to the at least one channel obstruction element, wherein the gas valve is arranged in the combustible gas channel, wherein said gas valve has a closed position wherein the combustible gas is prevented from flowing through the combustible gas channel, and an open position wherein the combustible gas is able to flow through the combustible gas channel. It should be noted that in this embodiment the gas valve and the channel obstruction element are both present, i.e. as separate components. The gas valve is arranged in the combustible gas channel, and the channel obstruction element can be arranged in either the combustible gas channel or the air channel. Optionally the controller is configured to control the gas valve.

This embodiment has the advantage that the combustible gas channel can be opened or closed using the gas valve, independent of the channel obstruction element. The functionalities are thus decoupled. In addition, it is possible to embody the gas valve with a simpler or cheaper construction, e.g. as a pneumatic gas valve.

In some embodiments the gas valve may be a control valve, e.g. an electronically actuated control valve, pneumatic actuated control valve, or hydraulic actuated control valve. In other embodiments the gas valve a pneumatic gas valve, preferably being part of a master-slave relation wherein the flow of air in the air channel is the master. For example, said pneumatic gas valve may be biased to a closed position and be opened due to a pneumatic force, wherein said force is dependent on the flow of air. The opening of the pneumatic gas valve at a certain air flow may be determined by the design of the pneumatic gas valve. In this system ratio of the combustible gas and the air is determined by the design of the pneumatic gas valve.

Optionally the pneumatic gas valve is designed with a negative offset, meaning that a predetermined threshold of air flow or under pressure must be present before the pneumatic gas valve can open. This avoids that there is an unwanted flow of combustible gas when there is no air flow, which could otherwise e.g. be caused by the pneumatic gas valve opening when there is an under pressure caused by other reasons, such as e.g. suction forces further downstream. Such an unwanted flow of combustible gas could result in the exhaust gases being flammable, which is not desired for safety reasons.

In an embodiment, the at least one channel obstruction element is a valve, e.g. an electronically actuated control valve, pneumatic actuated control valve, or hydraulic actuated control valve. This allows to accurately control the volume of combustible gas and/or air supplied to the mixing channel, and as such the lambda value of the premixed gas.

In a further embodiment, the at least one of the at least one obstruction element corresponds with the gas valve which is arranged in the combustible gas channel, wherein said gas valve has a closed position wherein the combustible gas is prevented from flowing through the combustible gas channel, and an open position wherein the combustible gas is able to flow through the combustible gas channel.

In an embodiment, the burner further comprises at least one oxygen sensor configured to measure a value representative of an oxygen content of a flue gas generated by the burner or representative of an oxygen content of the premixed gas supplied to the burner surface. The measured value may be representative of the lambda-value of the supplied premixed gas. The controller may be configured to control the lambda-value based on the measured value.

In an embodiment, the burner further comprises at least one flame detector configured to detect when the supplied premixed gas is ignited and/or burning, and generate a corresponding flame signal, wherein preferably the controller is further configured to control the premixed gas to have the second lambda-value after having received the flame signal from the detector. If premixed gas having the second lambda-value is supplied when the supplied premixed gas having the first lambda-value is not yet ignited, the premixed gases having the first and second lambda-values will mix. This may result in a resulting gas with a lambda-value which entails the risk of flame flashback. This risk is mitigated with the present embodiment. In a further embodiment, the controller may be configured to stop supplying premixed gas if the flame detector does not detect any ignition or burning of premixed gas after a predetermined time, e.g. being 2, 5 or 10 seconds.

In an embodiment, the burner comprises a perforated metal plate for stabilizing flames when the supplied premixed gas is burning. It is possible that said perforated metal plate corresponds with the burner surface, but it is also possible that said perforated metal plate is arranged on the inside of the burner surface, in that case the perforated metal plate is sometimes also referred to as distributor or pressure distributor. In an embodiment said perforated metal plate is embodied according to one or more of the embodiments shown in the following applications of the present applicant, said application being incorporated herein by reference: WO2011/069839, WO2009/077505, or WO02/44618.

In an embodiment, the burner comprises a second air channel having an air valve. The air valve has a first position wherein air can be supplied to the premixed gas via the second air channel at a first flow rate, and a second position wherein air can be supplied to the premixed gas via the second air channel at a second flow rate. The second flow rate may either be smaller or larger than the first flow rate, and optionally the second flow rate is nearly zero. The controller is further configured to control the air valve to be in the first position during the start-up phase, and in the second position during the operation phase. The air valve is preferably biased to the first position.

In an embodiment, the burner comprises a second combustible gas channel having a second combustible gas valve. The second combustible gas valve has a first position wherein combustible gas can be supplied to the premixed gas via the second combustible gas channel at a first flow rate, and a second position wherein combustible gas can be supplied to the premixed gas via the second combustible gas channel at a second flow rate. The second flow rate may either be smaller or larger than the first flow rate, and optionally the second flow rate is zero. The controller is further configured to control the second combustible gas valve to be in the second position during the start-up phase, and in the first position during the operation phase. The second combustible gas valve is preferably biased to the second position.

In an embodiment, the controller may further be configured modulate the burner between the minimum load and the full load. To do this, the controller may e.g. control the fan, and/or the gas valve, and/or one or more channel obstruction element.

In an embodiment, the burner may further comprise a combustion chamber, wherein e.g. the ignition source, and/or the oxygen sensor, and/or the flame detector are arranged.

In an embodiment, the burner may further comprises the fan, and optionally the controller is configured to control the fan.

The invention further relates to a hydrogen gas fired heating appliance comprising a burner according to the invention. The heating appliance may e.g. be used for household or industrial applications, e.g. for a boiler.

The invention will now be described by way of example with reference to the figures below, wherein the same reference numerals in different figures indicate the same characteristics. It should be noted, however, that the figures are only an example wherein several optional features are combined. The invention is not limited to what is shown in the figures.

Figure 6:
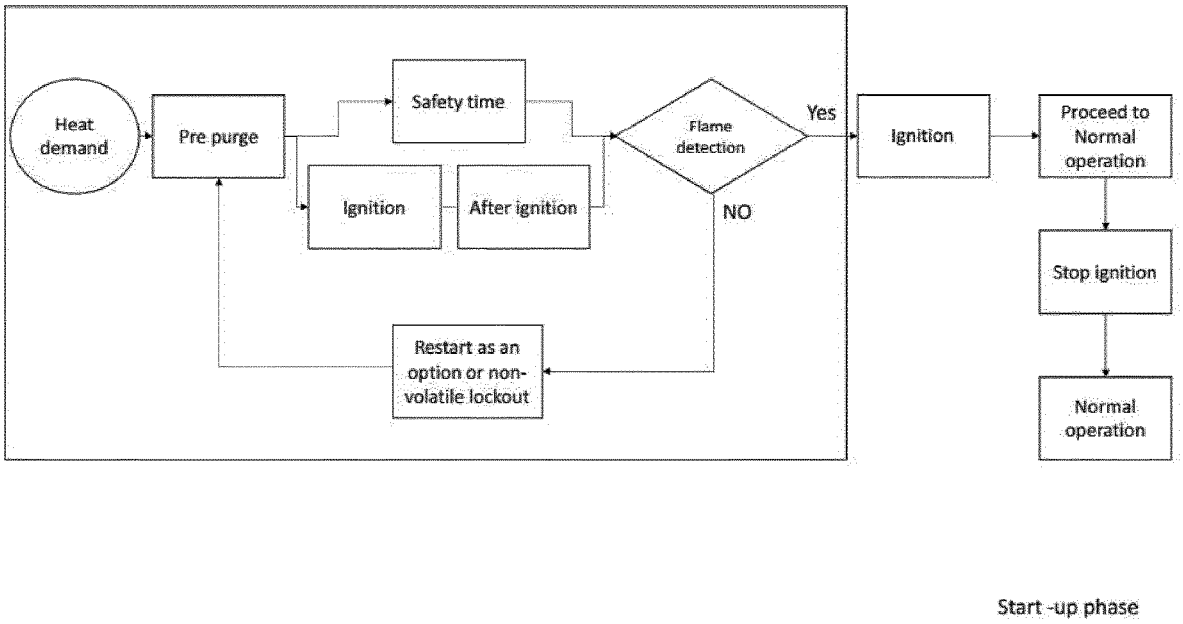

FIG. 6 schematically illustrates the steps of a method for starting a burner in accordance with a possible embodiment of the invention.

Figure 1:
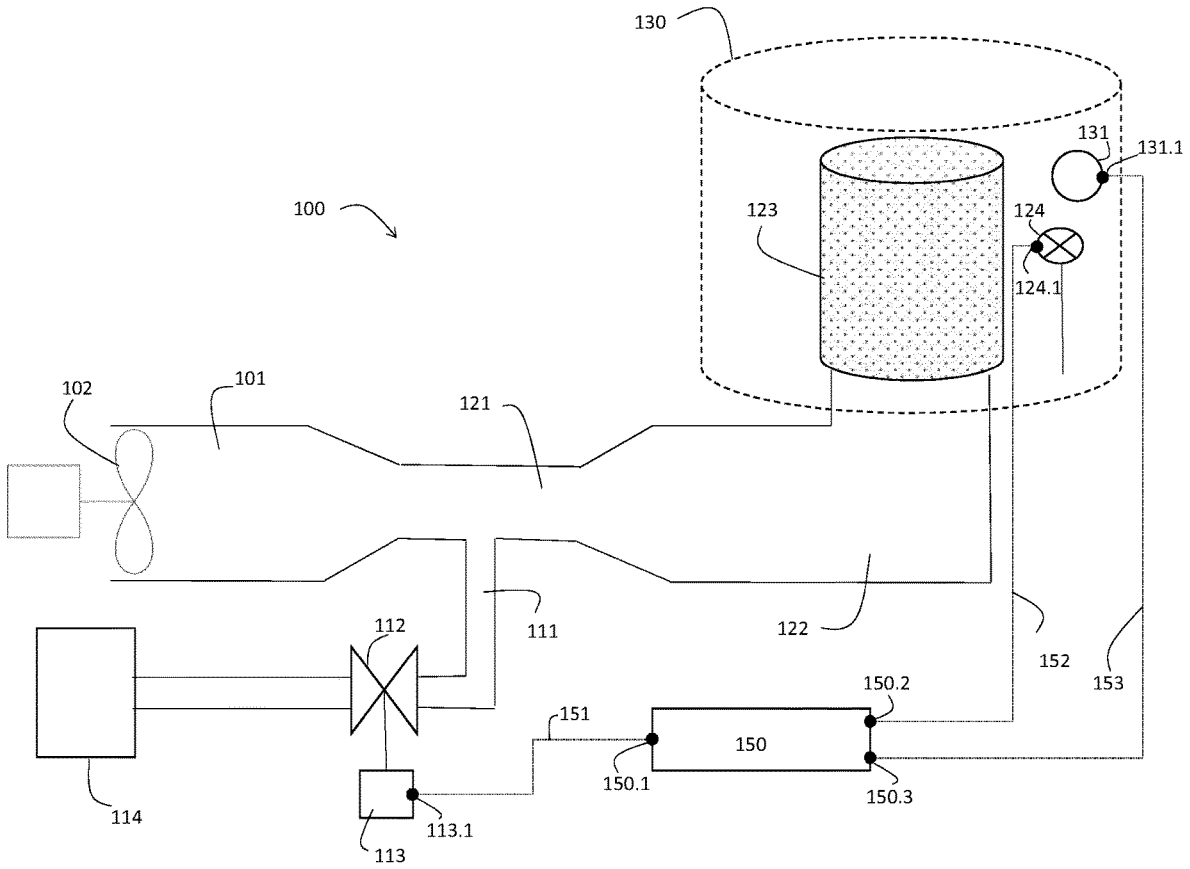
FIG. 1 illustrates a burner according to first embodiment of the invention.

FIG. 1 schematically illustrates a burner 100 first embodiment of the invention. The burner 100 preferably is a surface stabilized fully premixed gas premix burner, which can be modulated between a minimum load and a full load. The burner 100 comprises a burner surface 123, to which premixed gas is supplied by a premixed gas supply circuit. In the shown example, the burner surface 123 comprises perforations through which the premixed gas flows into a combustion chamber 130. The combustion chamber 130 may e.g. be part of heating appliance, wherein in particular water is heated. An ignition source 124 is further provided for igniting the supplied premixed gas. In the shown embodiment the burner surface 123 is schematically depicted as being round. However, in practice the burner surface 123 can have any suitable shape, e.g. round, curved or flat. The shape of the burner surface 123 may be dependent on the shape of the combustion chamber 130, and/or vice versa.

The premixed gas comprises combustible gas and air. Therefore, the premixed gas supply circuit comprises a combustible gas channel 111, which is connected to a combustible gas supply 114. The combustible gas supply 114 in the shown example is a tank, but other options include a distribution network similar as to what is known for the distribution of traditional hydrocarbon gasses such as methane in municipal or industrial areas. In the context of the present invention, the combustible gas comprises at least 50% by volume of hydrogen, in some embodiments at least 80%, at least 95% or at least 98%.

In the combustible gas channel 111 a gas valve 112 is provided, with which the quantity of combustible gas that flows through the combustible gas channel 111 can be regulated. In the shown example, the gas valve 112 is an electronically actuated control valve, controlled by an electronic actuator 113. However, it is also known to design the gas valve 112 such that it opens based on pneumatic forces. For example, the gas valve 112 may be biased to a closed position by a spring force, but automatically open to let the desired quantity of combustible gas through when an under pressure downstream of the gas valve 112 is created by a flow of air.

In order to be able to ignite the combustible gas, oxygen is required. In the present invention, air is used for supplying said oxygen. The premixed gas supply circuit therefore comprises an air channel 101 for providing air. Preferably, a fan 102 is provided for providing the air to flow. Although in the shown example the fan 102 is provided upstream of the location where the air channel 101 and the combustible gas channel 111 meet, in some embodiments the fan 102 may be arranged downstream of said location. It is also possible to arrange multiple fans, optionally on multiple locations. The air channel 101 is further upstream connected to an air supply (not shown). Usually, the air supply simply is the environmental air. For example, the air channel 101 may connected to the outside air, e.g. through a hole in a wall, and the fan 102 provides a suction force for sucking the air into the air channel 101.

FIG. 1 further shows that optionally the air channel 101 comprises a narrower portion 121, i.e. being narrower than the more upstream part of the air channel 101. The flow speed of the air increases in the narrower portion, and therefore the pressure reduces, as follows from Bernoulli's principle. The combustible gas channel 111 is connected to this narrower portion 121. Because of the reduced pressure of the air, a venture effect is created, since a suction force on the combustible gas is provided, resulting in improved mixing of the combustible gas and the air.

The premixed gas supply circuit further comprises a mixing channel 122. In the mixing channel 122 the air supplied by the air channel 101 and combustible gas supplied by the combustible gas channel 111 into a premixed gas to be supplied to the burner surface 123. Based on the composition of the combustible gas, a certain quantity of oxygen is required for complete combustion of the combustible gas. Based on the composition of the air, the quantity of required air can be derived from the quantity of required oxygen. Since in practice, the quantity of air will differ from this, a lambda-value is defined as a ratio between an actually supplied quantity of air and the quantity of air required for stoichiometric combustion of the premixed gas.

Usually the burner 100 is started following the following procedure. First, the fan 102 is started such that air flows through the air channel 101. Then, the ignition source 124 is started, but since there is no combustible gas yet, there will not be any combustion. Thereafter, the gas valve 112 is opened such that combustible gas can flow in the combustible gas channel 111. The combustible gas and air are mixed in the mixing channel 122 and through perforations of the burner surface 123 the premixed gas enters the combustion chamber 130. The ignition source 124, which is still activated, ignites the supplied premixed gas, and a combustion and flame are present in the combustion chamber 130.

If there is a malfunction or failure, however, for example of the ignition source 124, there may not be an immediate combustion of the supplied premixed gas. Consequently, premixed gas comprising the combustible gas will accumulate in the combustion chamber 130. The same will occur during a delayed ignition test. Test have shown that in case the combustible gas comprises a substantial quantity of hydrogen, several problems can occur if the accumulated premixed gas then after a certain amount of time is ignited. These problems can lead to undesired damage and/or danger. For example, a flame flashback can occur, i.e. the flame can propagate back through the burner surface 123. It can also happen that an explosion occurs in the combustion chamber 130.

Figure 2:
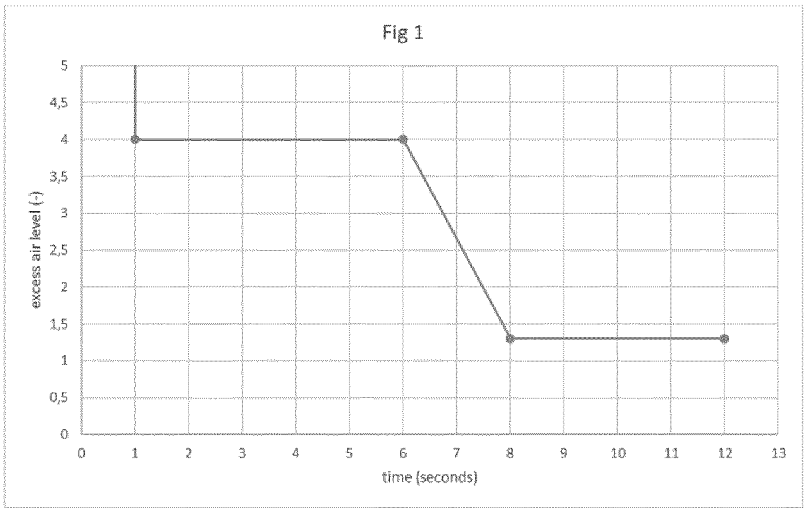
FIG. 2 illustrates an example of the lambda-value in function of time.

The present invention provides a solution by providing an additional excess of air during a start-up phase in comparison to an operation phase. An example of the lambda-value in function of time is shown in FIG. 2. As can be seen, the lambda-value is at 4 between the first and sixth second. Note that initially only the fan is started to provide air, and after 1 second combustible gas is added. After the eighth second, the lambda-value in the shown example is at approximately 1.3, although the exact lambda-value may be dependent on the load. Test have shown that the increased lambda-value during the start-up phase decreases the problems above. Note further that the load during the start-up phase may be different than the load in operation phase. During the transition from the start-up phase to the operation phase, which in FIG. 2 corresponds with the time period 6-8 seconds, the fan may also be adapted to provide a different flow.

With reference to FIG. 1, an embodiment of the implementation of the invention will further be elaborated. The burner 100 comprises a controller 150. The controller 150 is configured to control the lambda-value of the supplied premixed gas. In the shown example, the controller 150 does this by controlling the gas valve 112. In particular, the controller 150 has an output terminal 150.1 for sending a control signal 151 to an input terminal 113.1 of the actuator 113 of gas valve 112. By controlling the position of the gas valve 112, the quantity of combustible gas that enters the mixing channel 122 is controlled, and as such the ratio air to combustible gas and the lambda-value. It should be noted, however, that several other possibilities can be applied as alternative or in combination of the electronically actuated control gas valve 112, some of which are elaborated herein.

In accordance with the invention, the controller 150 is configured to supply premixed gas having first lambda-value during a start-up phase of the burner 100. The period before the ignition source 124 ignites the supplied premixed gas having the first lambda-value, is part of the start-up phase. Also the ignition itself is during the start-up phase. The controller 150 is further configured to supply premixed gas having a second lambda-value during an operation phase of the burner. The operation phase commences after the ignition source 124 has ignited the supplied premixed gas having the first lambda-value. According to the invention, the first lambda-value is larger than the second lambda-value.

In case of a failure or during a delayed ignition test, the premixed gas having the first lambda-value may accumulate in the combustion chamber 130, until it is ignited. Because the premixed gas that is initially ignited has the lower, first lambda-value, the flame speed is reduced. The risks of flame flashback and explosion are as such reduced.

Preferably, the first lambda-value is at least 1.85. It has been found that this is a practical lower limit with which satisfactory results can be achieved.

The burner 100 preferably comprises at least one channel obstruction element 112, which in the example shown in FIG. 1 is embodied as the gas valve 112. The channel obstruction element 112 in this embodiment is arranged such that it can partially obstruct the combustible gas channel 111. The controller 150 can control the channel obstruction element 112 by outputting a control signal 151 via output terminal 150.1 to input terminal 113.1 of actuator 113. During the start-up phase, the controller 150 controls the channel obstruction element 112 such that the combustible gas channel 111 is partially obstructed. As such, less combustible gas is supplied to the premixed gas, resulting in the first lambda value being larger.

Preferably, the channel obstruction element 112 is in a rest position during the start-up phase. So, the gas valve 112 may be biased to be partially closed, for example by means of one or more springs. By providing a force with the actuator 113, the gas valve 112 can be further opened to an actuated position during the operation phase, such that more combustible gas is supplied to the premixed gas. However, in case there is a failure, e.g. in the controller 150 or actuator 113, the gas valve 112 will remain in the rest position even during the operation phase, and the premixed gas in the operation phase will have the first lambda-value. Although this may lead to an inefficient combustion, safety is guaranteed, because it is avoided that during such failures the lambda-value during the start-up phase is too low.

There are several possible ways to implement when the transition from the start-up phase to the operation phase can be done. Preferably, the start-up phase lasts at least 1 second, preferably at least 2 seconds, and even more preferably at least 3 seconds, e.g. between 3-6 seconds. In some embodiments, the controller 150 can be configured to automatically switch to the operation phase after a predetermined amount of time.

FIG. 1 shows that an optional flame detector 131 is provided in the combustion chamber 130. The flame detector 131 is configured to generate a flame signal 153 when it detects a flame in the combustion chamber 130, which indicates that that the supplied premixed gas is ignited and/or burning. The flame detector 131 may be embodied according to any of the known suitable principles for flame detection. The flame signal 153 is outputted to the controller 150 via output terminal 131.1 and input terminal 150.3. The controller 150 can use the information provided by the flame signal 153 in several ways. For example, the controller 150 can be configured to only actuate the gas valve 112 to the actuated position after a flame is detected, thereby avoiding that premixed gas with the second lambda-value reaches the combustion chamber 130 before the already present premixed gas is ignited. This can be done as an alternative or in addition to waiting the predetermined amount of time as explained above. It is also possible that the controller 150 is able to control the ignition source 124, as e.g. indicated in FIG. 1 wherein a control signal 152 can be send via output terminal 150.2 and input terminal 124.1. In that case, the controller 150 can be configured to stop the ignition source 124 from igniting the premixed gas if no flame has been detected by the flame detector 131 after a certain amount of time. This would avoid dangerous situations when a substantial quantity of premixed gas has accumulated in the combustion chamber 130 without being ignited. It is noted that some standards prescribe this as a mandatory measure. On the other hand, by controlling the ignition source 124, it is also possible to ensure that the supplied premixed gas in the combustion chamber 130 only is ignited, when said premixed gas has a satisfactory lambda-value. It is also possible that the controller 150 controls the ignition source 124 to stay in an ignition state for an ignition period after detection of the initial ignition of the premixed gas. As such, accumulated premixed gas may be burned even when the flame has moved away from said accumulated premixed gas.

Figure 3:
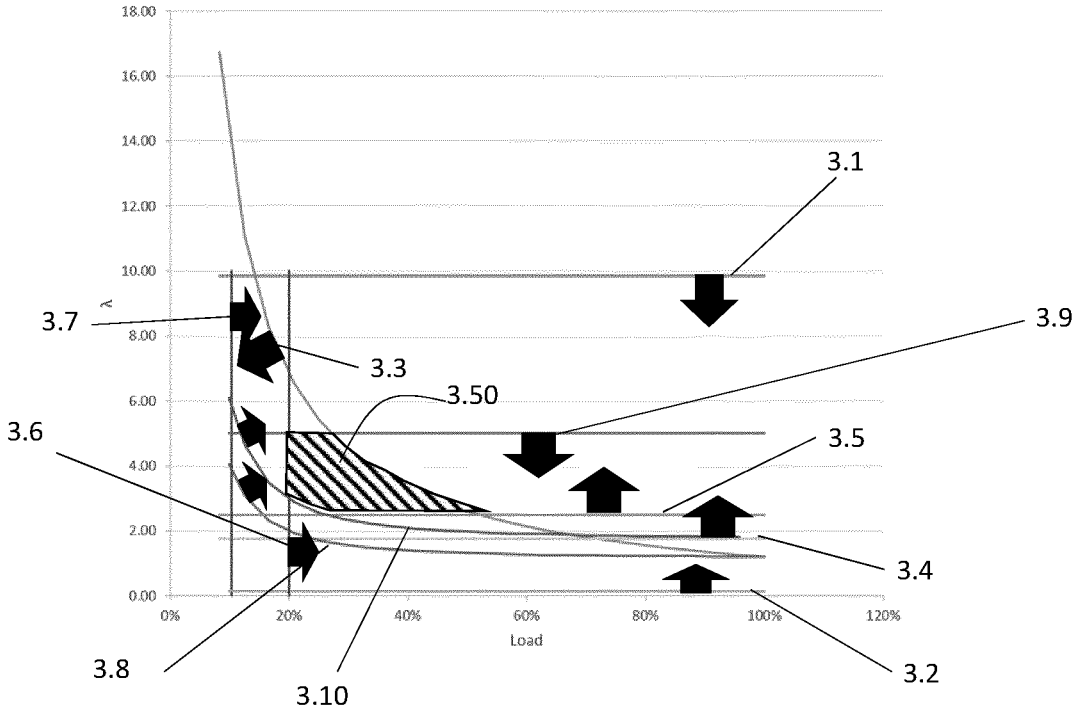
FIG. 3 illustrates a few factors that in optional embodiments can be taken into account when deciding the first and/or second lambda-value.

FIG. 3 illustrates a few factors that in optional embodiments can be taken into account when deciding the first and/or second lambda-value. These factors can be taken into account separately or in combination of each other. On the horizontal axis of FIG. 3, the load of the burner is expressed, and on the vertical axis the lambda-value is expressed. Each of the lines in the graph represent a different factor, which will be explained below. For each line, an arrow is provided indicating on which side of the respective line the lambda-value preferably should be.

The burner is configured to be modulate between a minimum and a full load. For example, for household heating appliances the full load may be 24 kW. Whereas traditionally the modulation ratio, i.e. the ratio of the full load over the minimum load, was around 4:1-5:1, recently modulation ratios of up to 10:1 have been proposed. In FIG. 3, line 3.6 illustrates the lower limit of 20% when the modulation ratio is 5:1, and line 3.7 shows the lower limit of 10% when the modulation ratio is 10:1.

The second lambda-value is normally in the range of 1.05-1.3, in particular at high or full load. A small excess of air is provided to avoid incomplete combustion in cases where the air and combustible gas are not sufficiently mixed, or the composition of the air and/or combustible gas deviate. Line 3.8 in FIG. 3 illustrates an example of the second lambda-value in function of the load. It has been found that when the combustible gas comprises a significant quantity of hydrogen, it may be optimal to adapt the lambda-value based on the load during the operation phase, thus e.g. the second lambda-value. As explained in European patent application with application Ser. No. 19/162,278, the lambda-value at the minimum load may be at least 20% higher than at full load, and optionally at average load the lambda-value may be less than 10% higher than at full load. In general, the burner will be started on a load within the modulation range. In accordance with the invention, the first lambda-value at any given load is higher than the second lambda-value at said load, when the burner is started at said load. This is indicated by line 3.10 in FIG. 3, which corresponds to line 3.8 multiplied by 1.5. In some embodiments, however, the burner may be started at a load that is below the minimum load, although this is limited by a reduced minimum load, since below that minimum load it may not be able to determine the flame or whether the burner is on or off within an acceptable time.

Preferably the first lambda-value is below a blow-off value. The blow-off value is the lambda-value at which there is so little combustible gas relative to air in the premixed gas, that any flame at the burner surface is blown out by the premixed gas, because there is not sufficient combustible gas to keep the flame burning.

Preferably, the first lambda-value is such that the concentration of combustible gas in the premixed gas is below an upper flammability limit, also referred to as UFL, indicated in FIG. 3 by line 3.2. Preferably, the first lambda-value is such that the concentration of combustible gas in the premixed gas is above a lower flammability limit, also referred to as LFL, indicated in FIG. 3 by line 3.1. Otherwise, it may not be possible to ignite the premixed gas, since the premixed gas is too rich or too lean, respectively. It should be noted that the concentration of combustible gas in the premixed gas being above a certain threshold, corresponds with the lambda-value being below a lambda-value corresponding with said threshold. It should further be noted that the upper and lower flammability limit is determined by the composition of the combustible gas, but also dependent on factors such as temperature and pressure.

In practice, the first lambda-value may also be limited by the fan, in particular in embodiments where the lambda-value is adjusted by partially obstructing the air channel. The maximal capacity or power of the fan determines the maximal quantity of air that can flow through the air channel, which with a given quantity of supplied combustible gas determines the lambda-value of the premixed gas. Of course, in theory it is possible to provide a larger fan, but in practice this may not be desirable because of cost considerations. Therefore, the first lambda-value preferably corresponds with a quantity of air that is lower than a quantity of air provided by the fan, when said fan is on full load. This is indicated in FIG. 3 by line 3.3. It is noted that the quantity of combustible gas may also be determined by the fan, in particular when the fan is arranged downstream of the location where the combustible gas channel and the air channel meet.

Preferably, the first lambda-value is such that the concentration of combustible gas in the premixed gas is below a lower explosion limit, also referred to as LEL, meaning that the first lambda-value should be above a lambda-value corresponding with the LEL, indicated in FIG. 3 by line 3.4. It may be preferable to control the first lambda-value to differ more than a predetermined safety margin from the lower explosion limit, e.g. the safety margin being a factor 1.2 or 1.5, indicated in FIG. 3 by line 3.5. This ensures safety start-up, even when the actual composition of the air or combustible gas differs from expectation.

Preferably, the first lambda-value is below lower temperature value, indicated in FIG. 3 by line 3.9. In this context the lower temperature value is defined as the value which causes the flame of ignited premixed gas to be at such a low temperature that it extinguishes. In case the combustible gas comprises exclusively hydrogen, said temperature is approximately 571 degrees Celsius.

As can be seen in FIG. 3, when following all of the above optional limitations, an ideal range for the first lambda-value becomes apparent, which is indicated by reference numeral 3.50 in FIG. 3. This can be used to determine optimal first lambda-value, based on the composition of the combustible gas and the air, as well as environmental conditions such as temperature and pressure. Depending on how many of the above factors are taken into account, this range can be determined with more precision. However, in some cases estimates or standard values may be used for one or more of the factors.

In practice, however, it may be cumbersome to determine the first and second lambda-value by determining all of the lines shown in FIG. 3. Out of tests and simulations, the applicant has found that in general the following rules of thumb give satisfactory results. The first lambda-value is at least 1.85, preferably at least 1.9, preferably larger than 2, e.g. between 2 and 5, preferably larger than 3, e.g. between 3 and 5, more preferably larger than 4, e.g. between 4 and 5. The second lambda-value can be taken between 1 and 2, preferably between 1.05 and 1.5, more preferably between 1.05 and 1.3. In general, the first lambda-value is preferably at least 1.5 times as large as the second lambda-value, preferably at least 2 times as large, e.g. at least 3 times as large.

Figure 4:
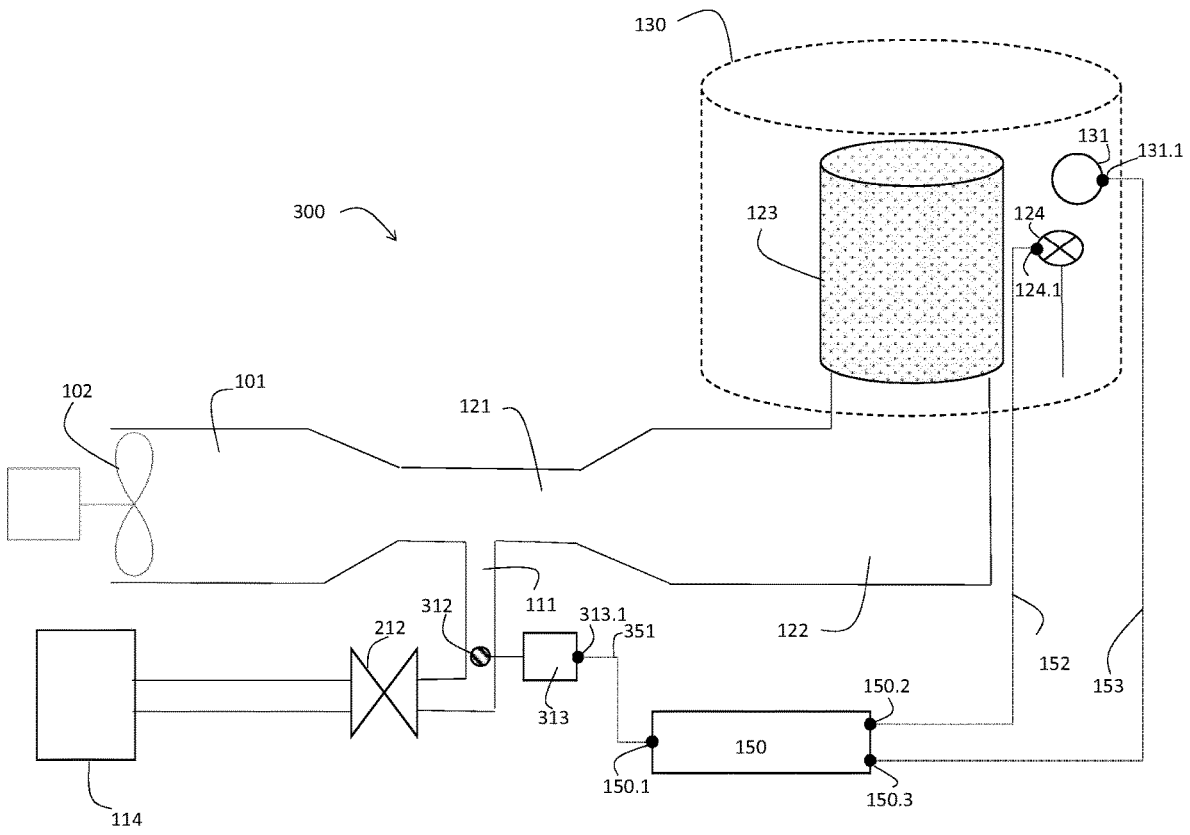
FIG. 4 shows a second embodiment of the burner according to the invention.

FIG. 4 shows a second embodiment of the burner 300 according to the invention. The burner 300 shown in FIG. 4 differs from the burner 100 shown in FIG. 1 in the channel obstruction element and the gas valve. In FIG. 4, the channel obstruction element 312 is not the same element as the gas valve 212, on the contrary, the channel obstruction element 312 is present in addition to the gas valve 212. In addition, in the shown embodiment the gas valve 212 is not an electronically actuated control valve, but it is a mechanism that opens based on the pneumatic force balance upstream and downstream of the valve 212; however, this is not a requirement for the embodiment of the channel obstruction element 312 as shown in FIG. 4.

The channel obstruction element 312 is configured to be arranged in the combustible gas channel 111 in a rest position, as is shown in FIG. 4. In a non-shown actuated position, the channel obstruction element 312 is not in the combustible gas channel 111, or at least the channel obstruction element 312 is obstructing the combustible gas channel 111 less in comparison to the rest position. An actuator 313 is provided to move the channel obstruction element 312 from the rest position into the actuated position. The channel obstruction element 312 is preferably biased into the rest positon, such that reverse movement back into the rest position can be done making use thereof, e.g. including spring forces or gravity forces. The actuator 312 can be configured to move the channel obstruction element 312 based on pneumatic, hydraulic, mechanical, and/or magnetic forces. The controller 150 is configured to control the actuator 313 with control signal 351 via output terminal 150.1 and input terminal 313.1. The controller 150 is configured to arrange the channel obstruction element 412 in the rest position during the start-up phase, and in the actuated position during the operation phase. The channel obstruction element 312 itself can take any suitable shape and form.

Figure 5:
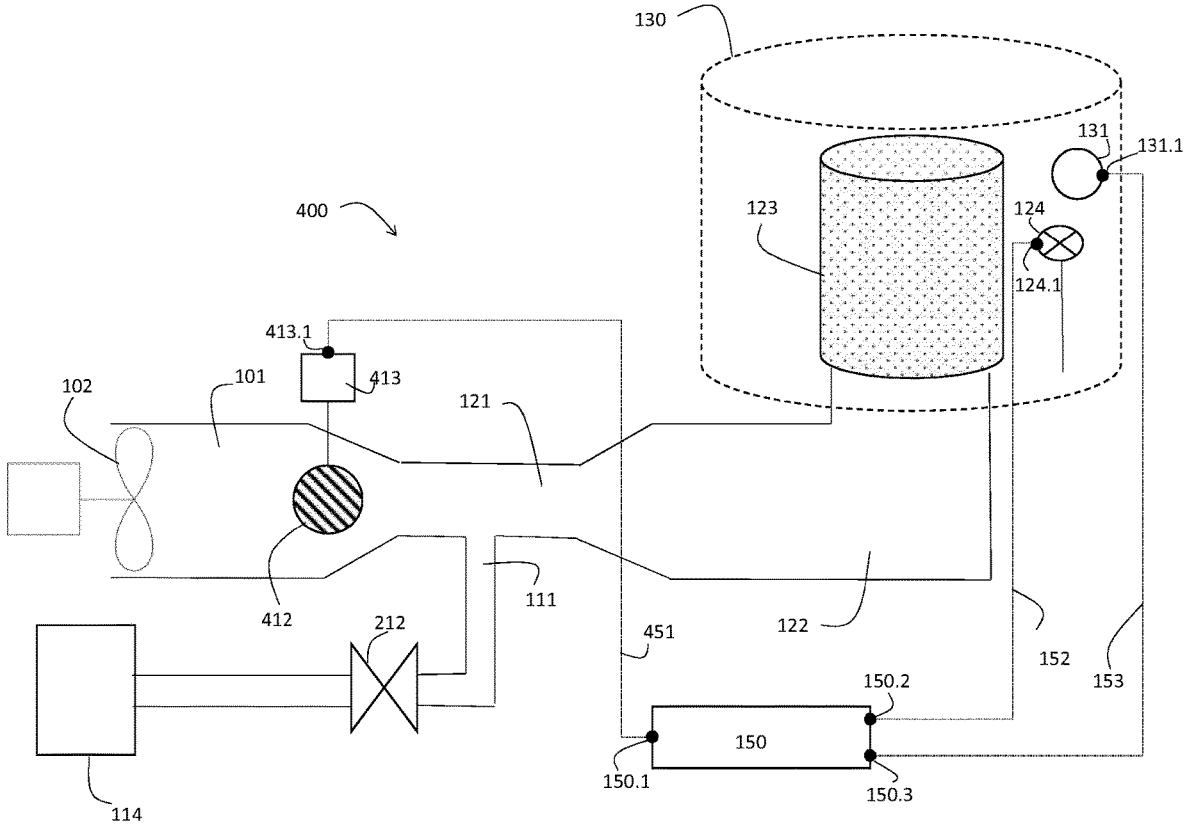
FIG. 5 shows a third embodiment of the burner according to the invention.

FIG. 5 shows a third embodiment of the burner 400 according to the invention. The burner 400 shown in FIG. 5 differs from the burner 100 shown in FIG. 1 in the channel obstruction element and the valve. In FIG. 5, the channel obstruction element 412 is not the same element as the valve 212. In addition, in the shown embodiment the valve 212 is not an electronically actuated control valve, but it is a mechanism that opens based on the pneumatic force balance upstream and downstream of the valve 212; however, this is nota requirement for the embodiment of the channel obstruction element 412 as shown in FIG. 5.

The channel obstruction element 412 is configured to be arranged in the air channel 101 in an actuated position, as is shown in FIG. 5. In a non-shown rest position, the channel obstruction element 412 is not in the air channel 101, or at least the channel obstruction element 412 is obstructing the air channel 101 less in comparison to the actuated position. An actuator 413 is provided to move the channel obstruction element 412 from the rest position into the actuated position. The channel obstruction element 412 is preferably biased into the rest positon, such that reverse movement back into the rest position can be done making use thereof, e.g. including spring forces or gravity forces. The actuator 412 can be configured to move the channel obstruction element 412 based on pneumatic, hydraulic, mechanical, and/or magnetic forces. The controller 150 is configured to control the actuator 413 with control signal 451 via output terminal 150.1 and input terminal 413.1. The controller 150 is configured to arrange the channel obstruction element 412 in the rest position during the start-up phase, and in the actuated position during the operation phase. The channel obstruction element 412 itself can take any suitable shape and form.

In this embodiment, differently from the embodiments shown in FIG. 1 and FIG. 3, the quantity of air is reduced during the operation phase rather than reducing the quantity of combustible gas during the start-up phase.

In a non-shown embodiment, the channel obstruction element 412 is configured to be arranged in narrower portion 121. Since narrower portion 212 is even narrower in that case, the speed increased further and the pressure reduces further, and more combustible gas will be sucked in by the reduced pressure.

FIG. 6 schematically illustrates the steps of a method for starting a burner in accordance with a possible embodiment of the invention. In step 1001, there is a heat demand. The heat demand may e.g. arise from the heating in a building being turned on, or warm water being requested by a tap or shower. The heat demand may optionally initiate a pre-purge in step 1002. A pre-purge entails that air is blown through the burner to ensure there are no combustible gasses present. After the pre-purging, premixed gas having the first lambda-value is supplied in step 1003 and an ignition source is controlled to be in an ignition state in step 1004. In the ignition state the ignition source is adapted to ignite the premixed gas having the first lambda-value. It is possible that step 1004 is performed before step 1003 or simultaneously with step 1003. Preferably the first lambda-value is at least 1.85. Optionally in step 1005 the ignition source is controlled to be no longer in the ignition state before in step 1006 a flame detection is performed with a flame detector. Step 1005 may in particular be beneficial if the ignition source, e.g. being a spark igniter, would otherwise adversely detect the flame detection, which also depends on the type of sensor being used as flame detector. The steps 1001-1006 are part of a start-up phase 1100.

In case no flame is detected in step 1006 after a safety time, step 1007 provides a restart, in which the pre-purge in step 1002 ensured that the non-combusted premixed gas is not present in the burner anymore. Optionally step 1007 can only be performed a predetermined number of times, such that the burner is completely shut down if it cannot be started after e.g. five tries. The safety time may be in accordance with EN15502.

If a flame is detected in step 1006, the method may optionally comprise a transition phase 1200 after the start-up phase 1100. The transition phase 1200 may in particular be beneficial if the burner is started at a start-up load in the start-up phase 1100 which is different from a desired load. In the shown embodiment, the transition phase 1200 comprises a step 1009 changing the lambda-value of the premixed gas that is being supplied to a second-lambda value associated with the start-up load if the load in the operation phase would be equal to said start-up load. The transition phase 1200 then comprises a step 1010 of changing the load to the desired load and changing the lambda-value to the second lambda-value associated with said desired load. Other embodiments of the transition phase 1200 are possible, as explained herein.

After the transition phase, the method may comprise an operation phase 1400. The operation phase 1400 comprises a step 1012 of supplying premixed gas having a second lambda-value to the burner surface. The first lambda-value is larger than the second lambda-value.

FIG. 6 further shows an optional ignition period 1300. The ignition period 1300 starts at a step 1008 in which the ignition source is controlled to be in the ignition state, and stops at a step 1011 in which the ignition source is controlled to not be in the ignition state. In the shown example, the ignition period 1300 corresponds with the end of the start-up phase 1100, the transition phase 1200, and the beginning of the operation phase 1400.

Although shown herein as separate embodiments, it is noted that is possible to combine one or more of the embodiment of FIG. 1, i.e. the gas valve 112 functioning as channel obstruction element 112; the embodiment of FIG. 4, i.e. the channel obstruction element 312 arranged in the combustible gas channel 111; and the embodiment of FIG. 5, i.e. the channel obstruction element 111 arranged in the air channel 101.

As required, this document describes detailed embodiments of the present invention. However it must be understood that the disclosed embodiments serve exclusively as examples, and that the invention may also be implemented in other forms. Therefore specific constructional aspects which are disclosed herein should not be regarded as restrictive for the invention, but merely as a basis for the claims and as a basis for rendering the invention implementable by the average skilled person.

Furthermore, the various terms used in the description should not be interpreted as restrictive but rather as a comprehensive explanation of the invention.

The word "a" used herein means one or more than one, unless specified otherwise. The phrase "a plurality of" means two or more than two. The words "comprising" and "having" are constitute open language and do not exclude the presence of more elements.

Reference figures in the claims should not be interpreted as restrictive of the invention. Particular embodiments need not achieve all objects described.

The mere fact that certain technical measures are specified in different dependent claims still allows the possibility that a combination of these technical measures may advantageously be applied.

The invention claimed is:

1. A method for starting a burner wherein a premixed gas comprising a combustible gas and air is supplied to a burner surface of the burner, wherein the combustible gas comprises at least 50% by volume of hydrogen, a lambda-value is defined as a ratio between an actually supplied quantity of air and the quantity of air required for stoichiometric combustion of the premixed gas, the burner is a surface stabilized fully premixed gas premix burner, the burner is configured to be modulated between a minimum load and a full load, wherein the method comprises the following steps:

during a start-up phase: supplying premixed gas having a first lambda-value to the burner surface, wherein the first lambda-value is at least 1.85, and igniting the supplied premixed gas having the first lambda-value using an ignition source, during an operation phase after the premixed gas has been ignited: supplying premixed gas having a second lambda-value to the burner surface, wherein the first lambda-value is larger than the second lambda-value.

2. The method according to claim 1, wherein the lambda-value is controlled during the start-up phase by controlling the quantity of air supplied by an air channel and/or the quantity combustible gas supplied by a combustible gas channel.

3. The method according to claim 1, wherein the burner comprises a premixed gas supply circuit, comprising an air channel for supplying air, a combustible gas channel for supplying combustible gas, a mixing channel for mixing air supplied by the air channel and combustible gas supplied by the combustible gas channel into the premixed gas to be supplied to the burner surface, and at least one channel obstruction element for partially obstructing the combustible gas channel and/or the air channel, wherein the method further comprises the following steps:

during the start-up phase: partially obstructing the combustible gas channel with the at least one channel obstruction element, such that less combustible gas is provided to the mixing channel during the start-up phase relative to the operation phase, and/or during the operation phase: partially obstructing the air channel with the at least one channel obstruction element, such that more air is provided to the mixing channel during the start-up phase relative to the operation phase.

4. The method according to claim 3, wherein the at least one channel obstruction element is arranged in a rest position in the start-up phase, wherein the method further comprises the step of actuating the channel obstruction element to arrange the channel obstruction element in an actuated position during the operation phase.

5. The method according to claim 1, wherein the first lambda-value is larger than 2.

6. The method according to claim 1, wherein the second lambda-value is between 1-2.

7. The method according to claim 1, the first lambda-value is at least 1.5 times as large as the second lambda-value.

8. The method according to claim 1, wherein the combustible gas comprises at least 75% by volume of hydrogen.

9. The method according to claim 1, wherein the start-up phase lasts at least 1 second.

10. The method according to claim 1, wherein the burner is started at a start-up load in the start-up phase which is different from a desired load in the operation phase, wherein the method further comprises a transition phase to transition from the start-up phase to the operation phase after the premixed gas has been ignited, wherein transition phase comprises a step of changing the load to the desired load.

11. The method according to claim 1, wherein the method further comprises a step of maintaining the ignition source in an ignition state for an ignition period after it has been detected that the supplied premixed gas having the first lambda-value has been ignited.

12. A burner configured to perform the method according to claim 1, the burner being a surface stabilized fully premixed gas premix burner.

13. A burner for burning a combustible gas comprising at least 50% by volume of hydrogen, wherein said burner is a surface stabilized fully premixed gas premix burner, and wherein said burner is configured to be modulated between a minimum load and a full load, said burner comprising:

a burner surface, a premixed gas supply circuit, comprising i. an air channel for supplying air, ii. a combustible gas channel for supplying combustible gas, iii. a mixing channel for mixing air supplied by the air channel and combustible gas supplied by the combustible gas channel into a premixed gas to be supplied to the burner surface, wherein a lambda-value is defined as a ratio between an actually supplied quantity of air and the quantity of air required for stoichiometric combustion of the premixed gas, an ignition source for igniting the premixed gas supplied to the burner surface, a controller configured to control the lambda-value of the supplied premixed gas by controlling the quantity of air supplied by the air channel and/or the quantity combustible gas supplied by the combustible gas channel, wherein the controller is configured to i. supply premixed gas having first lambda-value during a start-up phase of the burner wherein the ignition source is configured to ignite the supplied premixed gas having the first lambda-value, wherein the first lambda-value is at least 1.85, and ii. supply premixed gas having a second lambda-value during an operation phase of the burner after the ignition source is configured to ignite the supplied premixed gas having the first lambda-value, wherein the first lambda-value is larger than the second lambda-value.

14. The burner according to claim 13, further comprising at least one channel obstruction element for partially obstructing the combustible gas channel and/or the air channel, wherein the controller further is configured to control the at least one channel obstruction element to partially obstruct the combustible gas channel during the start-up phase and/or partially obstruct the air channel during the operation phase.

15. The burner according to claim 14, wherein the at least one channel obstruction element has an actuated position and a rest position, wherein the at least one channel obstruction element is configured to be in the actuated position during the operation phase and in the rest position during the start-up phase.

16. The burner according to claim 14, wherein the burner comprises a gas valve in addition to the at least one channel obstruction element, wherein the gas valve arranged in the combustible gas channel, wherein said gas valve has a closed position wherein the combustible gas is prevented from flowing through the combustible gas channel, and an open position wherein the combustible gas is able to flow through the combustible gas channel.

17. The burner according to claim 14, wherein the channel obstruction element is a valve.

18. The burner according to claim 13, further comprising at least one oxygen sensor configured to measure a value representative of an oxygen content of a flue gas generated by the burner or representative of an oxygen content of the premixed gas supplied to the burner surface.

19. The burner according to claim 13, further comprises at least one flame detector configured to detect when the supplied premixed gas is ignited and/or burning, and generate a corresponding flame signal, wherein preferably the controller is further configured to control the premixed gas to have the second lambda-value after having received the flame signal from the detector.

20. The burner according to claim 13, wherein the burner comprises a perforated metal plate for stabilizing flames when the supplied premixed gas is burning.

21. A hydrogen gas fired heating appliance comprising a burner according to claim 13.

* * * * *